US007806131B1

(12) United States Patent
Seiler

(10) Patent No.: US 7,806,131 B1
(45) Date of Patent: Oct. 5, 2010

(54) REVERSIBLE DECK UMBRELLA

(76) Inventor: Emily M. Seiler, 683 Berryville Ave., Winchester, VA (US) 22601

( * ) Notice: Subject to any disclaimer, the term of this patent is extended or adjusted under 35 U.S.C. 154(b) by 166 days.

(21) Appl. No.: 11/901,619

(22) Filed: Sep. 18, 2007

Related U.S. Application Data

(60) Provisional application No. 60/845,466, filed on Sep. 18, 2006.

(51) Int. Cl.
*A45B 25/18* (2006.01)
*A45B 15/00* (2006.01)

(52) U.S. Cl. ..... 135/33.2; 135/33.41; 135/33.5

(58) Field of Classification Search ..... 135/33.2, 135/33.4, 33.41, 33.5
See application file for complete search history.

(56) References Cited

U.S. PATENT DOCUMENTS 2,319,118 A * 5/1943 Farkas et al. ..... 135/31
3,429,320 A * 2/1969 Edelkind ..... 135/20.1
4,766,917 A 8/1988 Yang
5,429,147 A * 7/1995 Barrington ..... 135/33.5
D383,900 S 9/1997 Bart
5,890,506 A 4/1999 Kupferman
5,899,571 A 5/1999 Chalk
5,909,746 A 6/1999 Doster et al.
6,318,391 B1 11/2001 You
6,443,172 B2 9/2002 Brumfield
D475,524 S 6/2003 Clarke
6,866,053 B2 3/2005 You
D581,121 S * 11/2008 Austin et al. ..... D32/60
2006/0260668 A1 * 11/2006 Stollar ..... 135/115

* cited by examiner

*Primary Examiner*—David Dunn
*Assistant Examiner*—Danielle Jackson
(74) *Attorney, Agent, or Firm*—Montgomery Patent and Design; Robert C. Montgomery; Joseph T. Yaksich

(57) ABSTRACT

A reversible deck umbrella apparatus having reversible fabric coverings and changeable trim pieces, is herein disclosed. The umbrella comprises a textile product covering of a reversible design thus allowing for multiple fashion statements while prolonging the useful lifetime of the umbrella. The invention is configured on both sides with a variety of pockets and attachment points for the umbrella frame and interchangeable trim areas with various versions such as a solid flap, a pendant design, a scalloped design, a tassel design, and the like.

16 Claims, 5 Drawing Sheets

REVERSIBLE DECK UMBRELLA

RELATED APPLICATIONS

The present invention was first described in and claims the benefit of U.S. Provisional Application No. 60/845,466, filed Sep. 18, 2006, the entire disclosures of which are incorporated herein by reference.

FIELD OF THE INVENTION

The present invention relates generally to a reversible deck umbrella apparatus having reversible fabric coverings and changeable trim pieces and, more particularly, to an umbrella having a reversible design allowing for multiple fashion statements while prolonging the useful lifetime of the umbrella.

BACKGROUND OF THE INVENTION

Patio, deck and table umbrellas have been in use for years to provide shade and shelter for outdoor dining on backyard patios and at outdoor cafés across the country. In addition to the shade and shelter, they also provide a secluded ambiance which many find charming. Damage from ultraviolet (UV) radiation as well as the elements deteriorates the fabric requiring periodic replacement. During this replacement many find the underside in perfectly good shape. Also, the trim or valence areas on the side often become quickly damaged, and even if not, their aesthetic quality quickly diminishes with time.

Several attempts have been made in the past to design a reversible deck umbrella apparatus having a reversible design allowing for multiple fashion statements while prolonging the useful lifetime of the umbrella. U.S. Pat. No. 6,866,053 in the name of You discloses a telescopic shank of a beach umbrella invention for facilitating height adjustment and storage. In one embodiment, the shank comprises an upper support tube and a lower sliding tube comprising a top fastening mechanism. Such a fastening mechanism including an eccentric, intermediate shaft, an eccentric groove around the shaft, and a stop on the eccentric groove, and an eccentric "C"-shaped locking device put on the eccentric groove. The locking device including a stop block. In a sliding position, the stop and the stop block are opposite. Responsive to further rotating the sliding tube, the fastening mechanism, and the shaft about half circle about the support tube, the stop is urged against the stop block and an eccentric portion of the shaft and the stop urge against the locking device for biasing one side of the locking device against an inner wall of the support tube in a locked position. Unfortunately, this prior art example does not provide multiple fashion statements within one apparatus.

U.S. Pat. No. 6,443,172 in the name of Brumfield discloses a beach umbrella supported with a stand having a lower shaft and an upper shaft, with the upper shaft supporting a beach umbrella mast. Before attaching the umbrella mast, the tubular upper shaft serves as an impact tool against a protuberance on the lower shaft, allowing hammering of the lower shaft into composite earth. The upper shaft telescopes onto the lower shaft securing a tray in place against the protuberance after hammering is completed. Unfortunately, this prior art example does not provide multiple fashion statements within one apparatus.

U.S. Pat. No. 6,318,391 in the name of You describes a windproof umbrella comprises a canopy including an upper canopy, a lower canopy not equal to upper canopy in size, and a vent hole provided in the center portion of the lower canopy, and a multiple frame including a shank, stationary hubs fixed on the shank, rings slidable along the shank, ribs for supporting canopy, and spreaders. Air beneath the lower canopy exits through a gap formed between upper and lower canopies when frame is stretched. Also, rings moves synchronously along the shank such that the stretching and folding of upper and lower canopies can be smooth and synchronous.

None of the prior art particularly describes a reversible deck umbrella apparatus having reversible fabric coverings and changeable trim pieces and further having a reversible design allowing for multiple fashion statements while prolonging the useful lifetime of the umbrella. Accordingly, there is a need for a means by which patio umbrellas can be provided with increased aesthetic qualities and an increased useful life. The present invention satisfies such a need by providing an apparatus that is convenient and easy to use and lightweight yet durable in design. The present invention is simple to use, inexpensive, and designed for many years of repeated use.

SUMMARY OF THE INVENTION

In view of the foregoing disadvantages inherent in the prior art, it has been observed that there is need for a reversible deck umbrella apparatus having reversible fabric coverings and changeable trim pieces. The present invention is a patio or table umbrella with a reversible fabric covering and interchangeable valence and trim areas. It is envisioned that one side may be a solid color, while the other is a stripped or patterned design. Such a feature not only allows for multiple aesthetic characteristics, but prolongs the useful lifetime of the umbrella fabric as well. Various pockets and attachment points for the umbrella frame are provided on both sides. A vented top to reduce toppling is provided as well. Finally, the valence or trim areas on the side are changeable as well with various versions such as a solid flap, pendant design, scalloped design along with various tassels, fringes, etc. are envisioned. The use of this novel deck and table umbrella provides users all of the benefits of a patio umbrella, but with changeable aesthetics and a longer life as well.

A reversible deck umbrella includes a flexible double-sided canopy disposed over the existing ribs in such a manner that the canopy is effectively adapted to a generally inverted conical shape. Such a canopy includes first and second decorative sides with unique surface patterns.

The apparatus further includes a plurality of first and second pockets fitted about distal ends of the existing ribs. Such second pockets are oppositely situated adjacent to the first pockets. An aperture is conveniently formed at a central top portion of the canopy for receiving the existing central shaft therethrough, and a plurality of first and second hook-and-loop fasteners extend between adjacent pairs of the first and second pockets respectively.

The apparatus further includes a flap edge valence extending around an entire lower perimeter of the canopy. Such a valence includes a plurality of third and fourth hook-and-loop strips advantageously forming a removably attachable seam with the canopy. The flap edge valence includes a removably attachable textile border attached to the canopy and extending downwardly therefrom along an entire lower perimeter edge of the canopy, third and fourth decorative sides with unique surface patterns respectively, and at least one valence edge selected from a group including a tasseled valence edge and a pennant valence edge, respectively. The canopy and the flap edge valence are reversible in such a manner that the lower portion of the canopy transforms to an upper portion of the canopy. The valence portions are detachable from the canopy via the first, second, third, and fourth hook-and-loop fasteners respectively.

A method of installing and utilizing a reversible deck umbrella includes the steps of: erecting a deck umbrella frame with a plurality of ribs radially extending outward from a central shaft; positioning a canopy over the ribs by inserting the ribs into a plurality of first and second pockets of the canopy; attaching a flap edge valence portion to a lower portion of the canopy by adapting a plurality of first, second, third and fourth hook-and-loop fasteners between open and closed positions; reversing side portions of the canopy such that a lower surface of the valence portion transforms to become an upper surface of the valence portion; and exchanging valence areas based on desired decorative side portions of the valence portion.

The method further including the steps of adapting the first, second, third and fourth hook-and-loop fasteners to attach alternate valence areas to the canopy; and reversing decorative side portions of the valence areas to provide a desired alternate visual effect.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | reversible deck umbrella |
| 11 | base |
| 12 | shaft |
| 13 | finial assembly |
| 14 | rib |
| 20 | reversible fabric canopy |
| 21 | first pocket |
| 22 | second pocket |
| 23 | first hook-and-loop fastener |
| 24 | second hook-and-loop fastener |
| 25 | aperture |
| 26 | first decorative side |
| 27 | second decorative side |
| 30 | flap edge valence |
| 31 | third decorative side |
| 32 | fourth decorative side |
| 33 | third hook-and-loop fastener |
| 34 | fourth hook-and-loop fastener |
| 40 | tasseled edge valence |
| 50 | pennant edge valence |

DETAILED DESCRIPTION OF THE PREFERRED EMBODIMENT

Figure 1:
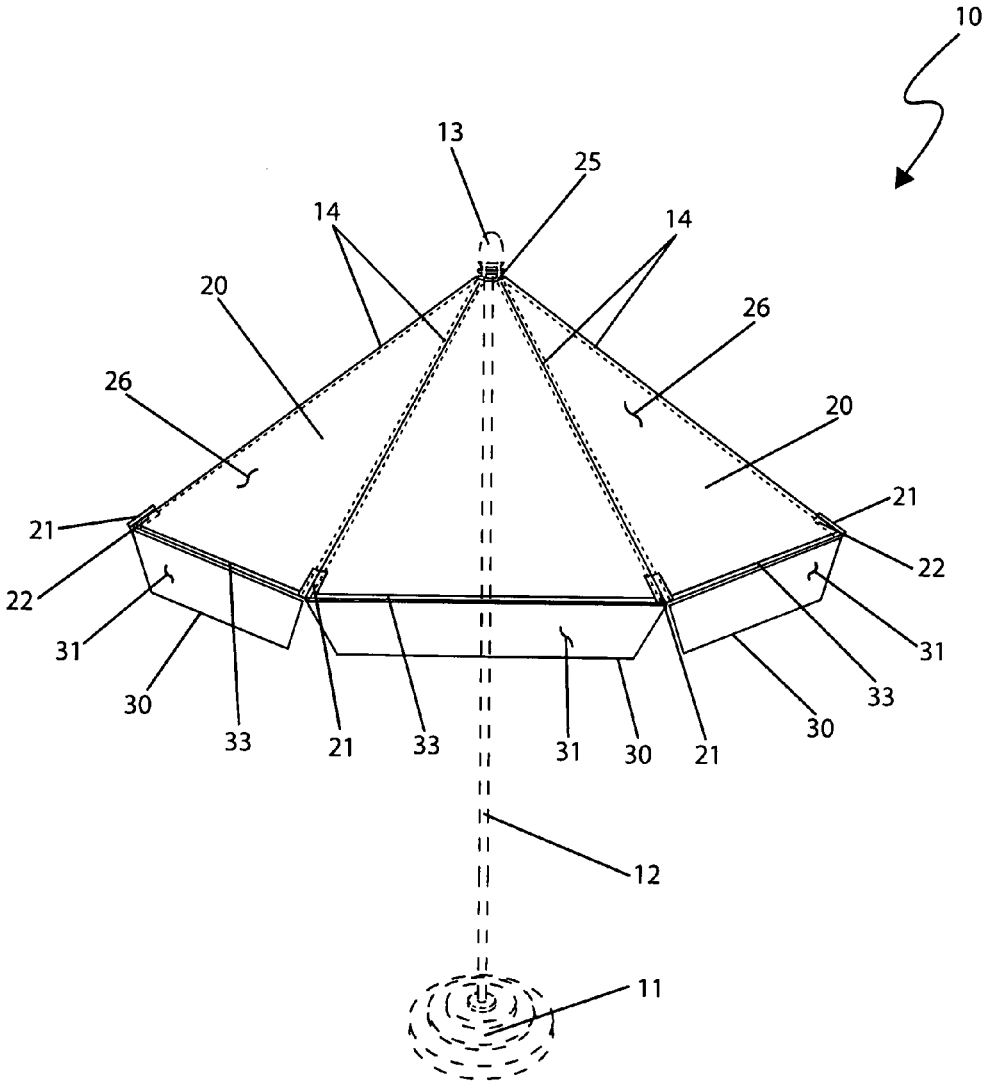
FIG. 1 is a perspective view of a reversible deck umbrella 10, according to a preferred embodiment of the present invention.
Figure 2A:
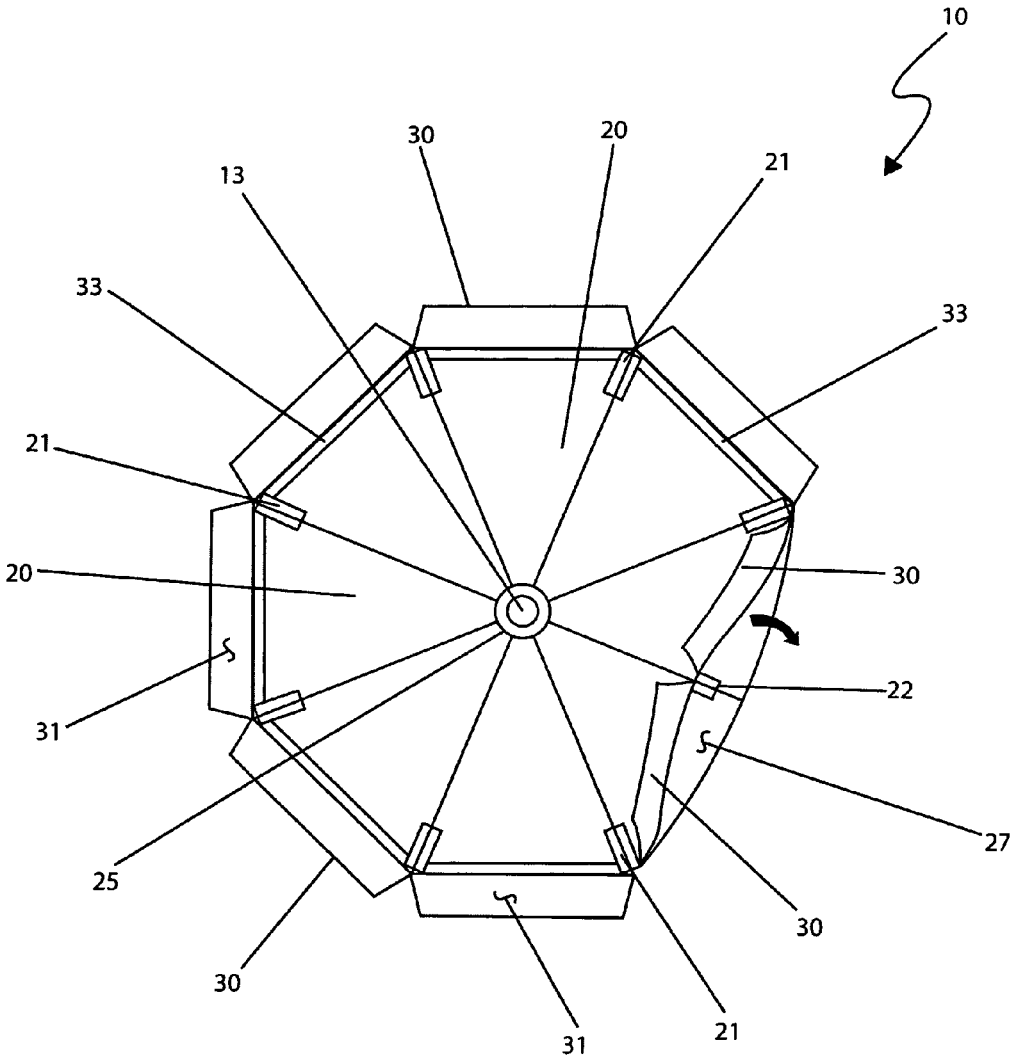
FIG. 2*a* is a top view of a reversible deck umbrella 10, according to a preferred embodiment of the present invention.
Figure 2B:
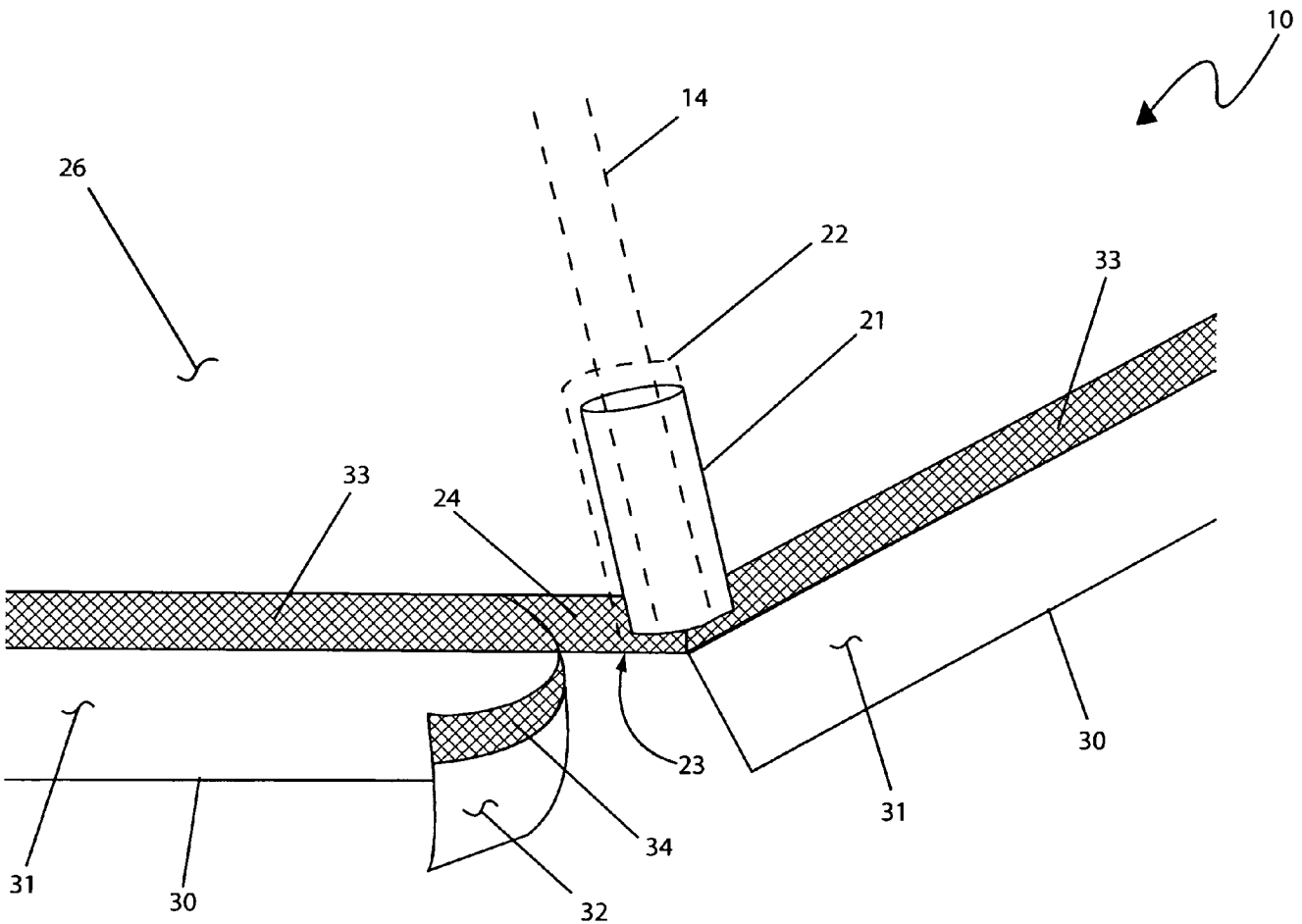
FIG. 2*b* is a close-up view of a flap edge valence portion 30 of a reversible deck umbrella 10, according to a preferred embodiment of the present invention.
Figure 3:
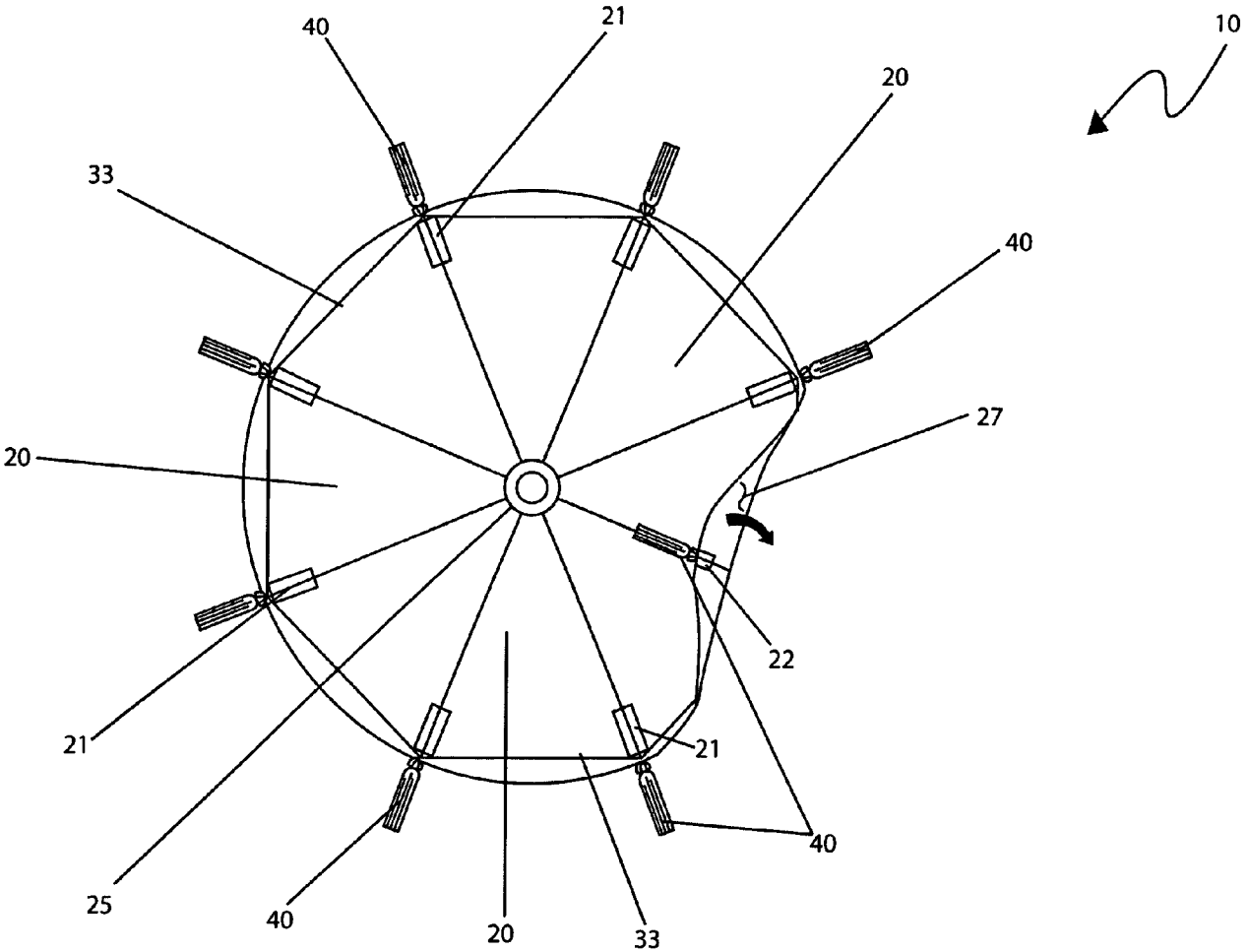
FIG. 3 is a top view of a reversible deck umbrella 10 comprising of a tasseled trim edge 40, according to an alternate embodiment of the present invention; and, FIG. 4 is a top view of a reversible deck umbrella 10 comprising of a pennant edge valence 50, according to another alternate embodiment of the present invention.
Figure 4:
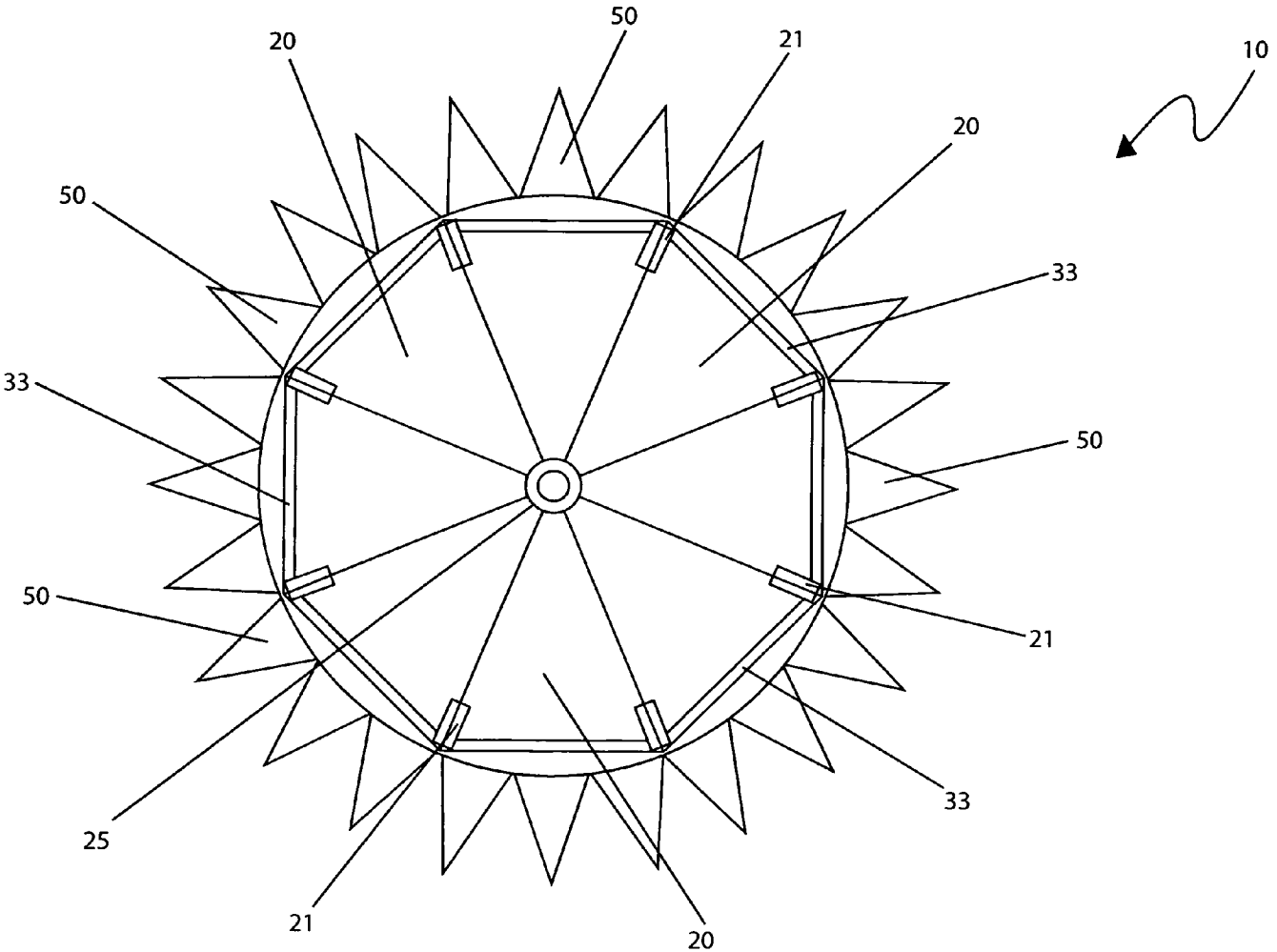

The best mode for carrying out the invention is presented in terms of its preferred embodiment, herein depicted within FIGS. 1 through 2*b* and as alternate embodiments as depicted in FIGS. 3 and 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that aids in decoration and protection of outdoor decks, patios, or other outdoor bases fabricated of wood, plastic, or other materials suitable to accommodate a plurality of weather conditions. The reversible deck umbrella (herein described as the "apparatus") 10, provides a means for a deck umbrella having reversible fabric coverings 20 and changeable valence and trim areas 30. The apparatus 10 comprises a textile canopy covering 20 of a reversible design thus allowing for multiple fashion statements while prolonging the useful lifetime of the apparatus 10. The invention 10 is configured on both sides with a variety of pockets 21, 22 providing attachment thereto ribs 14 of a conventional umbrella frame. The apparatus 10 also provides interchangeable valence areas with various versions such as a solid flap 30, a tassel design 40, a pennant design 50, and the like.

Referring now to FIGS. 1, 2*a*, and 2*b*, perspective, top, and close-up views of the apparatus 10, respectively, according to the preferred embodiment of the present invention, are disclosed. The apparatus 10 is illustrated here being applied thereto a fully deployed conventional deck umbrella frame comprising expected features such as, but not limited to, a central shaft 12, a support base 11, a final assembly 13, and radially extending ribs 14, cables, pulleys, hoisting mechanisms, locking detents, handles, and the like.

The apparatus 10 provides a reversible outdoor fabric canopy 20 comprising a plurality of first pockets 21, a plurality of second pockets 22, an aperture 25, a flap edge valence 30, and a plurality of first hook-and-loop fasteners 23, a plurality of second hook-and-loop fasteners 24, a plurality of third hook-and-loop strips 33, and a plurality of fourth hook-and-loop strips 34.

The apparatus 10 is envisioned to provide common outdoor umbrella sizes and designs with a reversible fabric canopy 20 and changeable valence and trim areas 30. The apparatus 10 is deployed in conjunction with the supporting ribs 14. The reversible fabric canopy 20 is disposed over a plurality of ribs 14 comprising an inverted conical shape. The reversible fabric canopy 20 is attached thereto said ribs 14 via the first 21 and second 22 pockets for operably receiving said ribs 14 to produce a taut canopy 20 fit thereon. The pockets 21, 22 provide a supportive positioning means thereto said ribs 14 along a lower perimeter region of the reversible fabric canopy 20. Said pockets 21, 22 comprise mirrored adjacent pairs of open-topped sewn-in sleeves along inner and outer surfaces of said reversible fabric canopy 20. The aperture 25 provides a sewn-in annular opening at a top central location of said reversible fabric canopy 20 providing an insertion means to the finial assembly 13 therethrough, in turn providing a centering means to the apparatus 10 thereupon the vertical shaft 12.

The first 23 and second 24 hook-and-loop fasteners extend in a linear and horizontal fashion therebetween adjacent pairs of pockets 21, 22 along inner and outer lower edges, respectively, being affixed thereto the reversible fabric canopy 20 using common textile methods such as adhesives, sewing, or the like. The first 23 and second 24 hook-and-loop fasteners provide a reversible fastening means thereto a valence area 30 all around a lower perimeter of the reversible fabric canopy 20. The flap edge valence 30 in turn comprises complimenting third 33 and fourth 34 hook-and-loop strips along inner and outer top edges in a corresponding manner thereto said first 23 and second 24 hook-and-loop fasteners. The third 33 and fourth 34 hook-and-loop strips form a removably attachable seam between said reversible fabric canopy 20 and the flap edge valence 30. The third 33 and fourth 34 hook-and-loop strips are envisioned to be made using similar materials and methods as the first 23 and second 24 hook-and-loop fasteners.

The reversible fabric canopy 20 is envisioned to be a foldable, weatherproof, mildew-proof, water-resistant textile material. The reversible fabric canopy 20 comprises a first decorative side 26 and a second decorative side 27 providing various aesthetically pleasing fabric colors and designs thereupon upper and lower surfaces. The flap edge valence 30 comprises a removably attachable vertical circular textile border attached thereto the reversible fabric canopy 20 extending downward therefrom an entire lower perimeter edge. The flap edge valence 30 is envisioned to be of similar weatherproof materials as said reversible fabric canopy 20. The flap edge valence 30 comprises a third decorative side 31 and a fourth decorative side 32 providing various aesthetically pleasing fabric colors and designs.

It is further envisioned that the decorative side portions 26, 27 of the reversible fabric canopy 20 and the decorative side portions 31, 32 of the flap edge valence 30 may be provided in matching or complementing patterns such as, for example, the reversible fabric canopy 20 portion may be a solid color, while the flap edge valence 30 may be a striped or patterned design. Additionally, a plurality of design techniques are envisioned for both portions 20, 30 so as to accommodate varying seasonal colors and/or designs. It is further envisioned that the decorative side portions 26, 27 of the reversible fabric canopy 20 and the decorative side portions 31, 32 of the flap edge valence 30 provide alternate colors and patterns thereupon. The reversible fabric canopy 20 and the flap edge valence 30 may be reversed upon user preference such that the lower portion would transform to become the upper portion and the upper portion transformed to become the lower portion. Said reversibility features allow multiple aesthetic characteristics and prolongs the useful lifetime of the apparatus 10.

Finally, it is envisioned that the apparatus 10 may function equally well with said flap edge valence 30 being detached and removed completely therefrom the apparatus 10 if desired.

Referring now to FIGS. 3 and 4, top views of the apparatus 10 comprising of a variety of changeable valence or trim areas including a tasseled edge valence 40 and a pennant edge valence 50, respectively, according to alternate embodiments of the present invention, are disclosed. It is envisioned that the changeable valence portions 40, 50 of the apparatus 10 may be detached from the reversible fabric canopy 20 via first 23, second 24, third 33, and fourth 34 hook-and-loop fasteners in a similar manner as the previously described preferred embodiment 10. The valence areas 40, 50 are envisioned to be introduced in a variety of styles such as, but not limiting to, a solid flap, a pennant design, a scalloped design, a ruffled design, various tassel designs, various fringes, and the like, and as such should not be interpreted as a limiting factor of the present invention 10. Said changeable valence areas 40, 50 permit multiple aesthetic characteristics while prolonging a useful lifetime of the apparatus 10 due to shared exposure thereto each decorative side portion 26, 27 of the reversible fabric canopy 20 and each decorative side portion 31, 32 of the flap edge valence 30 during use.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1 and comprising of alternate valence areas 40, 50 as indicated in FIGS. 3 and 4.

The method of installing and utilizing the apparatus 10 may be achieved by performing the following steps: erecting the deck umbrella frame in an expected manner utilizing the base 11, shaft 12, ribs 14, and finial assembly 13 upon an outdoor or deck surface; inserting the ribs 14 therein the pockets 21, 22; radially extending the ribs 14 in an expected manner to deploy the reversible fabric canopy 20; utilizing the hook-and-loop fasteners 23, 24, 33, 34 to attach the flap edge valence portion 30 thereto the reversible fabric canopy 20; reversing the side portions 26, 27 of the reversible fabric canopy 20 upon user preference such that the lower surface would transform to become the upper surface and the upper surface transformed to become the lower surface; exchanging valence areas 30 based on desired decorative side portions 31, 32 of the flap edge valence 30; and, enjoying a variety of fashion statements and refreshing visual effects afforded the user of the invention 10 while prolonging a useful lifetime thereof.

The method of installing and utilizing the alternate valence areas 40, 50 may be achieved by performing the following additional steps: utilizing the hook-and-loop fasteners 23, 24, 33, 34 to attach the alternate valence areas 40, 50 thereto the reversible fabric canopy 20 as described above; reversing the decorative side portions 31, 32 of the valence areas 40, 50 to provide a desired alternate visual effect.

Common outdoor umbrellas obtain damage from UV radiation as well as other weather elements forcing replacement on a periodic basis. The reversible and changeable features of the apparatus 10 are envisioned to increase the aesthetic qualities as well as the useful life. The apparatus 10 is configured therewith a variety of reversing reversible fabric canopies 20 and flap edge valence areas 30 in multiple colors and patterns providing simple reversing of said portions 20, 30 in accordance with decorative preference; needed repair and/or replacement resulting from a damaging weather event; or after damage from ultraviolet (UV) radiation, rain, snow, or other weather conditions.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A reversible deck umbrella for use with an existing frame having a plurality of ribs and a central shaft anchored thereto, said reversible deck umbrella comprising:

a canopy comprising an upper side and a lower side disposed over the existing ribs in such a manner that said canopy is adapted to a generally inverted conical shape;

a plurality of first pockets located on said upper side and a plurality of second pockets located on said lower side fitted about distal ends of the existing ribs, said second pockets being oppositely situated adjacent to said first pockets;

an aperture formed at a central top portion of said canopy for receiving the existing central shaft therethrough;

a plurality of first and second hook-and-loop fasteners extending between adjacent pairs of said first and second pockets respectively; and, a flap edge valence extending around an entire lower perimeter of said canopy, said valence including a plurality of third and fourth hook-and-loop strips forming a removably attachable seam with said canopy;

wherein each of said first and second pockets has an open end and a closed end axially opposed from said open end respectively.

2. The reversible deck umbrella of claim 1, wherein said upper and said lower side of said canopy comprises: first and second decorative sides having unique surface patterns.

3. The reversible deck umbrella of claim 1, wherein said flap edge valence comprises: a removably attachable textile border attached to said canopy and extending downwardly therefrom along an entire lower perimeter edge of said canopy.

4. The reversible deck umbrella of claim 1, wherein said flap edge valence comprises: third and fourth decorative sides having unique surface patterns respectively.

5. The reversible deck umbrella of claim 1, wherein said canopy and said flap edge valence are reversible in such a manner that a lower portion of said canopy transforms to an upper portion of said canopy.

6. The reversible deck umbrella of claim 1, wherein said flap valence edges comprise: at least one valence edge selected from a group including a tasseled valence edge and a pennant valence edge, respectively.

7. The reversible deck umbrella of claim 1, wherein said valence portions are detachable from said canopy via said first, second, third, and fourth hook-and-loop fasteners respectively.

8. A reversible deck umbrella for use with an existing frame having a plurality of ribs and a central shaft anchored thereto, said reversible deck umbrella comprising:

a flexible double-sided canopy comprising an upper side and a lower side disposed over the existing ribs in such a manner that said canopy is adapted to a generally inverted conical shape;

a plurality of first pockets located on said upper side and a plurality of second pockets located on said lower side fitted about distal ends of the existing ribs, said second pockets being oppositely situated adjacent to said first pockets;

an aperture formed at a central top portion of said canopy for receiving the existing central shaft therethrough;

a plurality of first and second hook-and-loop fasteners extending between adjacent pairs of said first and second pockets respectively; and, a flap edge valence extending around an entire lower perimeter of said canopy, said valence including a plurality of third and fourth hook-and-loop strips forming a removably attachable seam with said canopy;

wherein each of said first and second pockets has an open end and a closed end axially opposed from said open end respectively.

9. The reversible deck umbrella of claim 8, wherein said said upper and said lower side of canopy comprises: first and second decorative sides having unique surface patterns.

10. The reversible deck umbrella of claim 8, wherein said flap edge valence comprises: a removably attachable textile border attached to said canopy and extending downwardly therefrom along an entire lower perimeter edge of said canopy.

11. The reversible deck umbrella of claim 8, wherein said flap edge valence comprises: third and fourth decorative sides having unique surface patterns respectively.

12. The reversible deck umbrella of claim 8, wherein said canopy and said flap edge valence are reversible in such a manner that a lower portion of said canopy transforms to an upper portion of said canopy.

13. The reversible deck umbrella of claim 8, wherein said flap valence edges comprise: at least one valence edge selected from a group including a tasseled valence edge and a pennant valence edge, respectively.

14. The reversible deck umbrella of claim 8, wherein said valence portions are detachable from said canopy via said first, second, third, and fourth hook-and-loop fasteners respectively.

15. A method of installing and utilizing a reversible deck umbrella, said method comprising the steps of:

a. erecting a deck umbrella frame having a plurality of ribs radially extending outward from a central shaft;

b. positioning a canopy comprising an upper side and a lower side over said ribs by inserting said ribs into a plurality of first pockets located on said upper side and a plurality of second pockets located on said lower side of said canopy;

c. attaching a flap edge valence portion to a lower portion of said canopy by adapting a plurality of first, second, third and fourth hook-and-loop fasteners between open and closed positions;

d. reversing side portions of said canopy such that a lower surface of said valence portion transforms to become an upper surface of said valence portion; and, e. exchanging valence areas based on desired decorative side portions of said valence portion;

wherein each of said first and second pockets has an open end and a closed end axially opposed from said open end respectively.

16. The method of claim 15, further comprising the steps of:

f. adapting said first, second, third and fourth hook-and-loop fasteners to attach alternate valence areas to said canopy; and, g. reversing decorative side portions of said valence areas to provide a desired alternate visual effect.

* * * * *